United States Patent [19]

Schumaker

[11] Patent Number: 4,756,477

[45] Date of Patent: Jul. 12, 1988

[54] PLATE FOR SUPPORTING RAILWAY RAILS AND A TRACK ASSEMBLY USING IT

[75] Inventor: Jon S. Schumaker, Mantua, N.J.

[73] Assignee: Pandrol Limited, London, United Kingdom

[21] Appl. No.: 77,229

[22] Filed: Jul. 24, 1987

[51] Int. Cl.[4] ..... E01B 9/00

[52] U.S. Cl. ..... 238/315; 238/294; 238/297; 238/310

[58] Field of Search ..... 238/294, 297, 310, 315, 238/351

[56] References Cited

U.S. PATENT DOCUMENTS

| | | | |
|---|---|---|---|
| 1,495,876 | 5/1924 | Berryman | 238/294 |
| 1,555,382 | 9/1925 | Pronini | 238/294 |
| 2,417,385 | 3/1947 | Tilly | 238/294 |
| 4,349,151 | 9/1982 | Schumaker | 238/349 |
| 4,513,912 | 4/1985 | Schumaker | 238/349 |

FOREIGN PATENT DOCUMENTS

| | | | |
|---|---|---|---|
| 1481645 | 8/1977 | United Kingdom | 238/310 |

*Primary Examiner*—A. Michael Chambers
*Attorney, Agent, or Firm*—Norbert P. Holler

[57] ABSTRACT

An elongate plate, for use in a railway frog or switch to receive two inclined rails which stand on the plate and on another plate like it and are to be anchored thereto, has an elongate hole through it, with the length of the hole being parallel to that of the plate. A recess is formed in the underneath face of the plate at one end of the elongate hole by counterboring after the elongate hole has been formed by punching, the recess forming a widening of the undersurface region of the elongate hole at that end thereof. Correspondingly, an associated clip anchoring device includes an upper part for anchoring a rail clip and a lower part which has an inverted T shape. The clip anchoring device is fitted to the plate by first inserting its inverted T part into the elongate hole, then sliding the clip anchoring device towards the part of the plate upon which the rail is to stand until the cross arm of the inverted T part is located in the recess, and finally turning the clip anchoring device about a vertical axis until the resultant orientation of the cross arm transverse to the elongated hole ensures that merely pulling the clip anchoring device vertically upwardly will not result in its being lifted clear of the plate. After the clip anchoring device has been installed and the associated rail put in place, the anchoring device is turned to a position dictated by the orientation of the rail.

4 Claims, 3 Drawing Sheets

PLATE FOR SUPPORTING RAILWAY RAILS AND A TRACK ASSEMBLY USING IT

This invention relates to a plate for supporting railway rails and to a railway track assembly using it.

DESCRIPTION OF THE PRIOR ART

Where two adjacent running rails laid on rail ties (also known as sleepers) in a railway track are inclined to one another by a small angle, for example in a fabricated frog (also known as a crossing) formed from rails of standard cross-section, rails of non-standard cross-section and spacers assembled with the aid of bolts and nuts or in a switch, it is conventional to use on each tie two elongate so-called "twin hook plates" (called simply "plates" below) which are identical to one another and side by side and lie along the tie. Each plate lies under the two rails and is formed with only one somewhat hook-shaped lug on its upper side. In the case where the rails run approximately east to west, one lug, near the north end of one plate, will overlie and hold down the north side of the flange at the bottom of one rail and the other lug, near the south end of the other plate, will overlie and hold down the south side of the flange at the bottom of the other rail. It would be desirable to have each plate extending at right-angles to the rail which it holds down for then there would be maximum area of contact between its lug and the rail flange, since the part of the lug which overlies the rail flange, when seen in a plan view of the track, is not inclined to the length of the plate. However, since the plates are secured to the tie at both ends of the plates and since the tie is too narrow to allow each plate to be at right-angles to its rail, the two plates are in practice parallel to one another, with their longitudinal axes inclined by a small angle to the length of the tie and it has to be accepted that there is only a small area of contact between each lug and its associated rail flange. The other sides of the rail flanges have been held down by other means, for example by cut-spikes driven into the ties through holes in the plates.

In the case of cast frogs it is common to have outwardly-extending flanges at the bottom of the two sides of the frog and these flanges have been held down by plates as described above.

It is publicly known in the United States of America to use, with switches and frogs, plates with no lugs but with, instead, welded-on so-called "shoulders" which receive so-called "P-R clips" or "e-clips" (such as are sold by Pandrol Incorporated under the registered trade mark "PANDROL") which hold the rails down. The shoulder has an upper part formed with a passageway through it for receiving an upwardly-pressing leg of the clip and an abutment surface for receiving a downwardly-pressing further leg of the clip, another leg of the clip serving to press downwardly on the flange of the rail. It has also previously been proposed, other than by the applicant, to use, in switches or frogs, a shoulder having a passageway and an abutment surface as described above, which receive a "P-R clip" or an "e clip", the shoulder not being welded to a plate but having a stem or lower part which is wholly of circular cross-section, as seen from above, and is inserted in a keyhole-shaped hole through the plate. That previous proposal, which the applicant believes can properly be regarded as a matter of public knowledge in the United States of America, involved forming this hole by drilling a circular hole through the plate, part of this hole being in that area of the plate upon which the rail is subsequently to stand, and then milling the plate to form a continuation of the hole on the side of the hole which is remote from that area. After the milling process, the plate is left with, at its lower side, an opening in the form of a conventional athletics track, with two straight and parallel sides and two semi-circular ends, one of which is formed by the hole drilled through the plate whilst the other is remote from that area of the plate upon which the rail is to stand and, at the upper side of the plate, an opening having two straight parallel sides, a part-circular enlargement at one end constituted by the hole drilled through the plate and a semi-circular other end, the width of this semi-circular end and the distance between the two straight and parallel sides being less than the diameter of the drilled hole. The stem of the shoulder has at its lower end an enlargement in the form of a circular disc which is inserted from above into the drilled hole in the plate, whereupon the shoulder is bodily moved away from the above-mentioned area to a position in which the enlargement of the stem of the shoulder lies in the opening in the lower side of the plate but cannot pass upwardly into the opening in the upper side of the plate because that opening is too narrow. The shoulder can now turn about the vertical axis of its stem.

The milling process according to this previous proposal is expensive and results in the plate being weakened at a location directly vertically below the rail.

OBJECTS OF THE INVENTION

It is an object of the invention to produce plates for use in pairs with frogs and switches, with clip anchoring devices and clips anchored by them, the plates being inexpensive to make and robust. It is another object of the invention to produce a method of making such plates and it is a further object of the invention to produce a railway track assembly using such a plate.

BROAD OUTLINE OF THE INVENTION

In the following description and claims the word "rail" is intended to embrace a cast frog.

According to a first aspect of the present invention, there is provided an elongate plate which is suitable for supporting rails on a railway track, the plate, when in a particular orientation, comprising a flat horizontal upper surface on a particular area of which the foot of a flange-footed railway rail is to stand, a flat horizontal lower surface, portions of the plate defining holes through the plate from the upper surface to the lower surface remote from said area to receive fastening elements which serve to secure the plate to an underlying support structure and further portions of the plate defining a hole through the plate from the upper surface to the lower surface beside said area, this hole being elongate as seen in plan view with its length substantially parallel to the length of the plate, and a recess extending upwardly from the lower surface of the plate but not reaching the upper surface, the recess having a roof within the plate and forming a widening of the elongate hole at the lower face of the plate at that end of the elongate hole which is nearer said area, whereby a rail clip anchoring device with an inverted T part on its lower side may have its inverted T part inserted from above into said elongate hole whilst the cross-arm of the T is parallel to the length of said elongate hole, after which the anchoring device may be moved to said one end of the elongate hole and then turned about a vertical axis to a position in which the roof of the recess would prevent the device being removed from the plate merely by pulling the device vertically upwardly.

According to a second aspect of the invention, there is provided a method of making an elongate plate which is suitable for supporting rails on a railway track, comprising first forming an imperforate elongate plate which, when in a particular orientation, comprises a flat horizontal upper surface on a particular area of which the foot of a flange-footed railway rail is to stand and a flat horizontal lower surface, and then punching holes through the plate, which holes extend from the upper surface to the lower surface of the plate at locations remote from said area to receive fastening elements which serve to secure the plate to an underlying support structure and punching a further hole through the plate, this hole extending from the upper surface to the lower surface of the plate beside said area and being elongate as seen in plan view with its length substantially parallel to the length of the plate, and then counterboring the plate at its lower surface so as to form a recess extending upwardly from the lower surface of the plate but not reaching the upper surface, the recess having a roof within the plate and forming a widening of the elongate hole at the lower face of the plate at that end of the elongate hole which is nearer said area.

According to a third aspect of the invention, there is provided an assembly on a railway track comprising an elongate plate which in one orientation has a flat horizontal upper surface and a flat horizontal lower surface, a rail standing on the plate, portions of the plate defining holes through the plate from the upper surface to the lower surface remote from said area, fastening elements which pass through the holes and serve to secure the plate to an underlying support structure, further portions of the plate defining a hole through the plate from the upper surface to the lower surface beside said rail, the hole being elongate as seen in plan view with its length substantially parallel to the length of the plate, and a recess extending upwardly from the lower surface of the plate but not reaching the upper surface, the recess having a roof within the plate and forming a widening of the elongate hole at the lower face of the plate at that end of the elongate hole which is nearer said area, a rail clip anchoring device comprising an inverted T part on its lower side with the cross-arm of the inverted T part lying in said recess and a rail-fastening clip having a portion anchored by the anchoring device and another portion bearing downwardly upon the flange of the rail.

The rail clip anchoring device, when the cross-arm of its inverted T part lies in said recess but when the rail is not beside it, is preferably able to turn about a vertical axis through an angle of about 45° or more from a central position without the device being removable from the plate merely by moving it vertically upwardly. If the rail clip anchoring device is one having a passageway through it, the central position will be one in which the passageway is at right angles to the length of the plate. When the rail is part of a frog or crossing having several plates in pairs on the various ties, the anchoring devices will adopt differing orientations with respect to the plates, according to the angles which the rail makes with the ties at various locations along the track.

BRIEF DESCRIPTION OF THE DRAWINGS

An example in accordance with the invention is described below with reference to the accompanying drawings, in which.

DETAILED DESCRIPTION OF AN EMBODIMENT OF THE INVENTION

Figure 1:
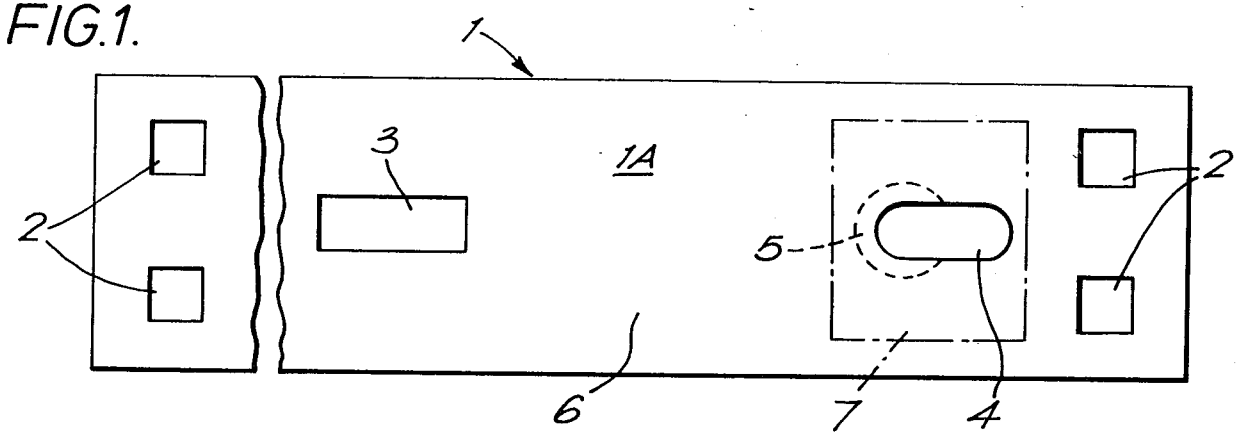
FIG. 1 shows a plan view of a plate for use in a frog or switch on a railway track.
Figure 2:
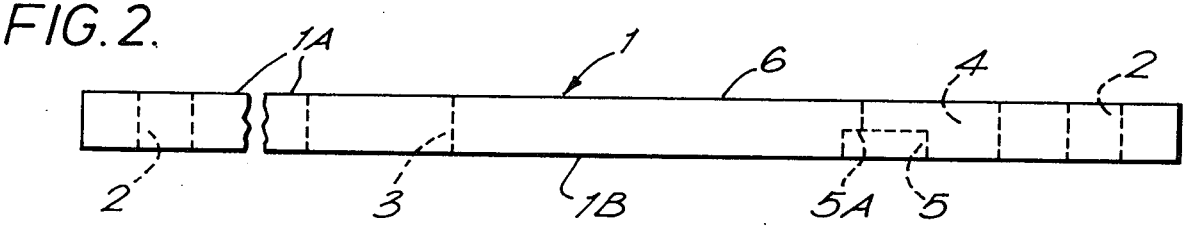
FIG. 2 shows a side view of the plate shown in FIG. 1.

The plate 1 shown in FIGS. 1 and 2 is a rectangular steel plate 27 inches long, 4 inches wide and 0.75 inch thick. It is one of several plates to be used at places in a frog or a switch where two rails are inclined to one another but not far apart. At places in the frog or switch where two inclined rails are further apart, it is proposed to use similar plates but 36 inches long. If necessary, similar plates having lengths other than 27 or 36 inches will be used additionally.

The illustrated plate is initially imperforate and, in the orientation shown in FIG. 2, has a flat horizontal upper surface 1A and a flat horizontal lower surface 1B. It is then formed in a single punching operation with four square holes 2, one oblong rectangular hole 3 and one elongate hole 4 which is in the form of an oblong rectangle with semi-circular ends, these holes passing through the plate from the surface 1A to the surface 1B and the lengths of the holes 3 and 4 being parallel to the length of the plate 1. Then the plate is counter-bored at its lower surface 1B so as to form a recess 5 extending upwardly from the lower surface of the plate but not reaching the upper surface 1A, the recess having a roof 5A within the plate and forming a widening of the hole 4 at that end of the hole 4 which is nearer an area 6 of the upper surface of the plate, upon which area a rail is to stand. FIG. 1 shows by chain lines a clip anchoring device 7 fitted to the plate 1, although in practice its working position will be not as shown in FIG. 1 but turned from the position shown in FIG. 1 by a few degrees about a vertical axis.

Figure 3:
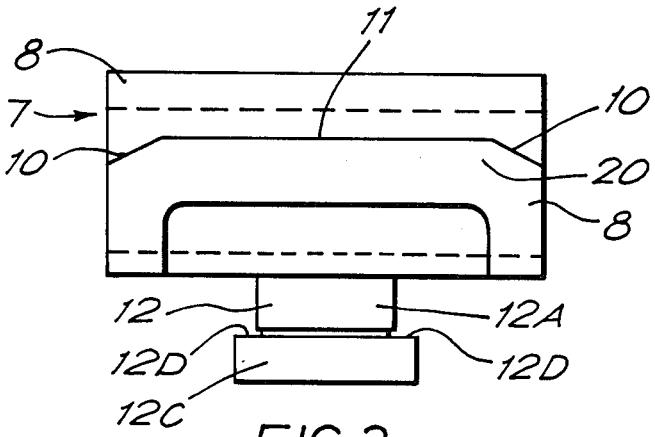
FIG. 3 shows a view from one side of a clip anchoring device.
Figure 4:
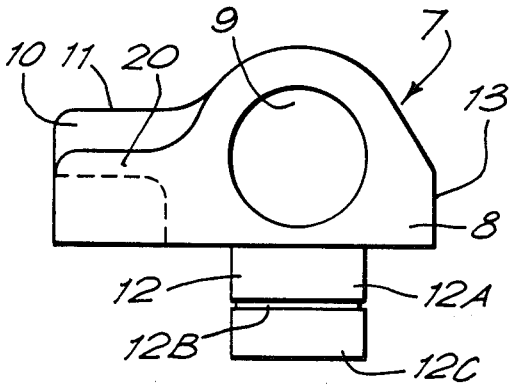
FIG. 4 shows a view from another side of the same device.

FIGS. 3 and 4 show a clip anchoring device 7, otherwise known as a "shoulder", for a P-R clip or an e-clip, the device being made of malleable cast steel and comprising a head portion 8 having a passageway 9 through it, for reception of a substantially straight leg of the clip, which leg presses upwardly on the roof of the passageway, the head portion also having a ledge 20 formed with a ramp surface 10 at each end leading to a flat top 11 of the ledge, on which the so-called "heel" of the clip is to press downwardly, and a vertical surface 13 for locating the flange of a rail. The device 7 also comprises a tail portion 12 for securing the device to the plate 1. The tail portion 12 is of circular cross-section in its upper part 12A and in a narrower portion 12B below that but is of oblong rectangular cross-section in its lower part 12C, these cross-sections being taken in planes which are horizontal and perpendicular to the paper in FIGS. 3 and 4. Thus the part 12 of the device is in the form of an inverted T, as can be seen in FIG. 3.

The anchoring device 7 shown in FIGS. 3 and 4 can be fitted to the plate 1 shown in FIGS. 1 and 2 by inserting the tail portion 12 of the device 7 into the hole 4 in the plate whilst the length of the part 12C is parallel to the length of the hole 4, then sliding the device 7 towards the area 6 of the plate 1 and then turning the device 7 about a vertical axis through an angle of more than 45°, for example nearly 90°. Then the device 7 cannot be removed from the plate 1 simply by lifting the device 7 vertically upwardly because this would be prevented by abutment surfaces 12D on the part 12C abutting the roof 5A of the recess 5. Also the device 7 cannot be removed from the plate simply by sliding the device 7 away from the area 6 and then lifting it; it has to be turned about a vertical axis.

Figure 5:
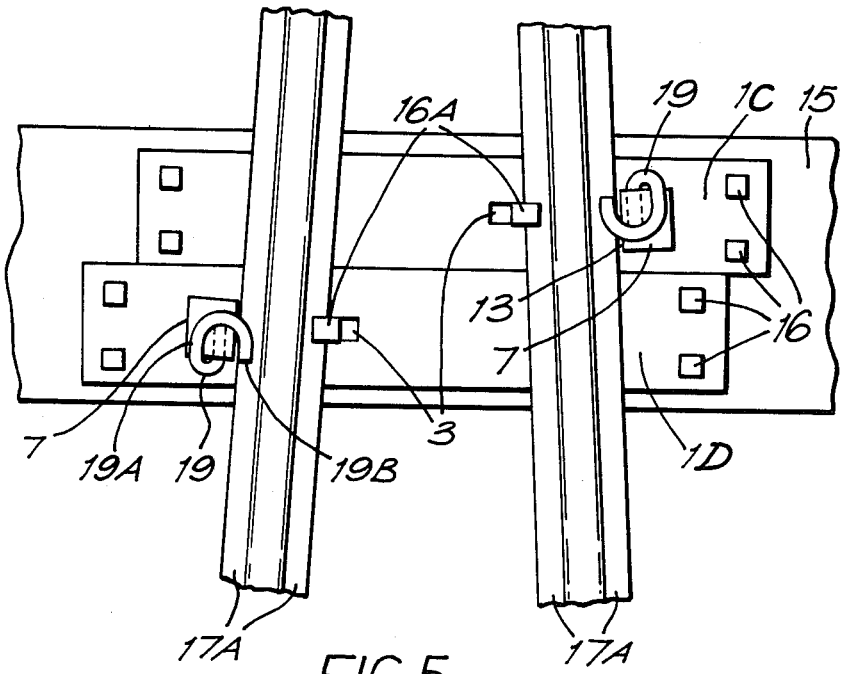
FIG. 5 shows a plan view of part of a frog lying on a sleeper.
Figure 6:
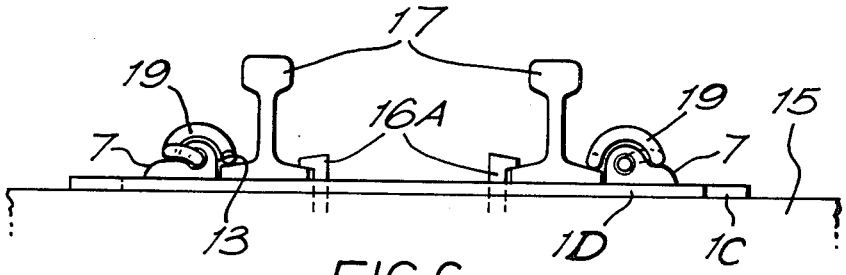
FIG. 6 shows an end view of the part of the frog which is shown in FIG. 5.

FIGS. 5 and 6 show a wooden railway tie 15 on which there lie two plates 1C and 1D, each as shown at 1 in FIGS. 1 and 2, with the hole 4 through one of them on the left side and the hole 4 through the other of them on the right side. The plates are secured to the tie by spikes 16 which pass through the holes 2 into the tie 15 after rails 17 have been positioned to abut the surfaces 13 on the devices 7. Spikes 16A, passing through the holes 3 and into the tie, hold down the proximal sides of the flanges 17A of the rails and the distal sides of the flanges are held down by e-clips 19, the substantially straight legs of which are driven into the passageways 9 in the devices 7. The heels 19A and toes 19B of the clips press downwardly on the tops 11 of the ledges 20 and on the flanges 17A of the rails 17. It can be seen from FIG. 5 that the plates 1C and 1D are touching and parallel to the length of the tie and the devices 7 are differently inclined so that the passageways 9 are not at right-angles to the lengths of the plates 1C but are parallel to the respective rails.

An important feature of the assembly shown in FIGS. 5 and 6 is that no part of any hole 4 or recess 5 lies directly vertically below the rail. The fact that all the holes 2, 3 and 4 are formed in a single punching operation which has only to be followed by a counterboring step to produce the recess 5 makes for speedy and economical production.

The support structure underlying the rails and the plates in the assembly according to FIGS. 5 and 6 is a wooden tie but in general the support structure could be a concrete tie, a steel tie or a concrete slab extending along the railway track. For any such case it may be preferable to use round holes, instead of the square holes 2, to receive fixing bolts.

The two plates 1C and 1D shown in FIGS. 5 and 6 could be replaced by a single larger plate with two holes 4 and two holes 3 through it. It is also possible to use a still larger plate instead of four, six or more of the plates shown in FIGS. 1 and 2, the larger plate having four, six or more holes 4 and 3 through it.

I claim:

1. An elongate plate which is suitable for supporting rails on a railway track, the plate, when in a particular orientation, comprising a flat horizontal upper surface on a particular area of which the foot of a flange-footed railway rail is to stand, a flat horizontal lower surface, portions of the plate defining holes through the plate from the upper surface to the lower surface remote from said area to receive fastening elements which serve to secure the plate to an underlying support structure and further portions of the plate defining a hole through the plate from the upper surface to the lower surface beside said area, this hole being elongate as seen in plan view with its length substantially parallel to the length of the plate, and a recess extending upwardly from the lower surface of the plate but not reaching the upper surface, the recess having a roof within the plate and forming a widening of the elongate hole at the lower face of the plate at that end of the elongate hole which is nearer said area, whereby a rail clip anchoring device with an inverted T part on its lower side may have its inverted T part inserted from above into said elongate hole whilst the cross-arm of the T is parallel to the length of said elongate hole, after which the anchoring device may be moved to said one end of the elongate hole and then turned about a vertical axis to a position in which the roof of the recess would prevent the device being removed from the plate merely by pulling the device vertically upwardly.

2. A plate according to claim 1 in which at least that end of said elongate hole which is nearer said area is semi-circular, as seen in plan view, and the outline of said recess, as seen in plan view, corresponds in shape to more than half of a circle.

3. A method of making an elongate plate which is suitable for supporting rails on a railway track, comprising first forming an imperforate elongate plate which, when in a particular orientation, comprises a flat horizontal upper surface on a particular area of which the foot of a flange-footed railway rail is to stand and a flat horizontal lower surface, and then punching holes through the plate, which holes extend from the upper surface to the lower surface of the plate at locations remote from said area to receive fastening elements which serve to secure the plate to an underlying support structure and punching a further hole through the plate, this hole extending from the upper surface to the lower surface of the plate beside said area and being elongate as seen in plan view with its length substantially parallel to the length of the plate, and then counterboring the plate at its lower surface so as to form a recess extending upwardly from the lower surface of the plate but not reaching the upper surface, the recess having a roof within the plate and forming a widening of the elongate hole at the lower face of the plate at that end of the elongate hole which is nearer said area.

4. An assembly on a railway track comprising an elongate plate which in one orientation has a flat horizontal upper surface and a flat horizontal lower surface, a rail standing on the plate, portions of the plate defining holes through the plate from the upper surface to the lower surface remote from said area, fastening elements which pass through the holes and serve to secure the plate to an underlying support structure, further portions of the plate defining a hole through the plate from the upper surface to the lower surface beside said rail, the hole being elongate as seen in plan view with its length substantially parallel to the length of the plate, and a recess extending upwardly from the lower surface of the plate but not reaching the upper surface, the recess having a roof within the plate and forming a widening of the elongate hole at the lower face of the plate at that end of the elongate hole which is nearer said area, a rail clip anchoring device comprising an inverted T part on its lower side with the cross-arm of the inverted T part lying in said recess and a rail-fastening clip having a portion anchored by the anchoring device and another portion bearing downwardly upon the flange of the rail.

* * * * *

UNITED STATES PATENT AND TRADEMARK OFFICE

CERTIFICATE OF CORRECTION

PATENT NO. : 4,756,477

DATED : July 12, 1988

INVENTOR(S) : JON S. SCHUMAKER

It is certified that error appears in the above-identified patent and that said Letters Patent is hereby corrected as shown below:

In column 6, line 50, for "said area" read --an area of said plate on which said rail stands--.

Signed and Sealed this

Twenty-sixth Day of October, 1993

*Attest:*

*Attesting Officer*

BRUCE LEHMAN

*Commissioner of Patents and Trademarks*